United States Patent [19]

Ishida et al.

[11] 4,164,721

[45] Aug. 14, 1979

[54] MAGNETIC ACTUATOR FOR A SHUTTER MECHANISM

[75] Inventors: Tokuji Ishida, Daito; Tetsuhiko Inagaki, Sakai, both of Japan

[73] Assignee: Minolta Camera Kabushiki Kaisha, Osaka, Japan

[21] Appl. No.: 748,966

[22] Filed: Dec. 9, 1976

[30] Foreign Application Priority Data

Dec. 11, 1975 [JP] Japan ..... 50/148047
Feb. 2, 1976 [JP] Japan ..... 51/10750

[51] Int. Cl.[2] ..... H01F 7/08; H01F 7/04

[52] U.S. Cl. ..... 335/234; 335/79; 335/229

[58] Field of Search ..... 335/234, 230, 229, 231, 335/178, 180, 79, 80, 81, 78; 310/36; 336/110

[56] References Cited

U.S. PATENT DOCUMENTS

| | | | |
|---|---|---|---|
| 2,888,290 | 5/1959 | Pierce | 335/229 |
| 2,899,124 | 8/1959 | Chausson | 310/36 |
| 3,530,454 | 9/1970 | Zocholl | 335/234 |
| 3,949,332 | 4/1976 | Reuting | 335/81 |

*Primary Examiner*—Harold Broome
*Attorney, Agent, or Firm*—Jackson, Jones & Price

[57] ABSTRACT

A magnetic yoke and armature actuator assembly for controlling a shutter mechanism of a camera and the like is provided. The yoke is formed to provide two integral magnetic pole portions of high magnetic permeability. The yoke can be designed for operative connection with a permanent magnet, for instance, by inserting a permanent magnet into a slot in either the yoke or the armature. The armature can be spring biased away from the pole portions of the yoke. The strength of the spring will be designed to be less than that of the magnetic flux created by the permanent magnet so that the armature will be held against the pole pieces during normal operation. The yoke can have a coil wound about one pole portion whereby an electric current flowing through the coil will neutralize the magnetic force of the permenent magnet thereby releasing the armature. The contact faces of the pole portions can be accurately machined in a mass production assembly line.

21 Claims, 14 Drawing Figures

FIG. 1
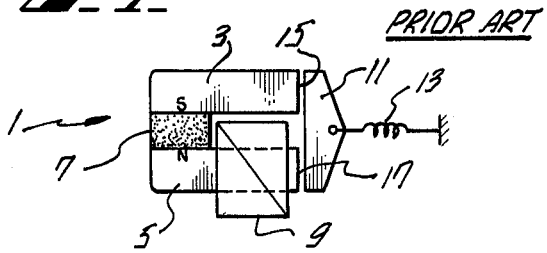
FIG. 3
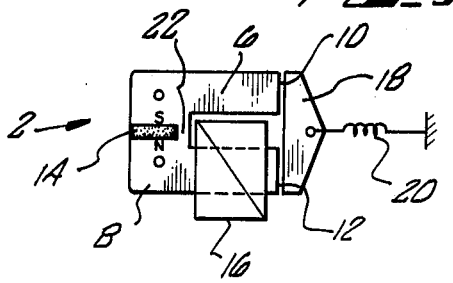
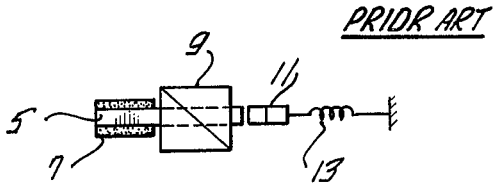
FIG. 2
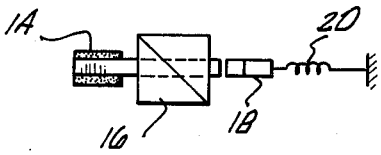
FIG. 4
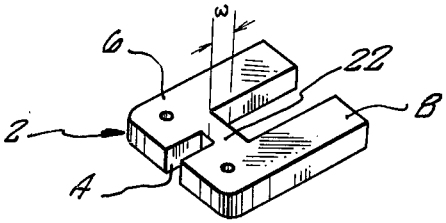
FIG. 5
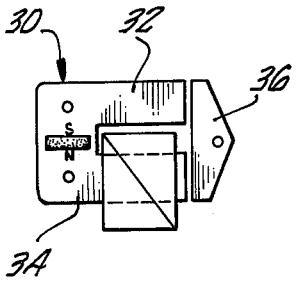
FIG. 6
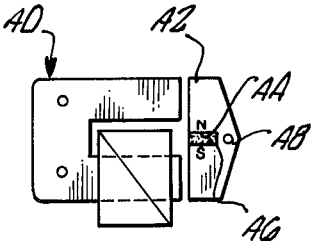
FIG. 7
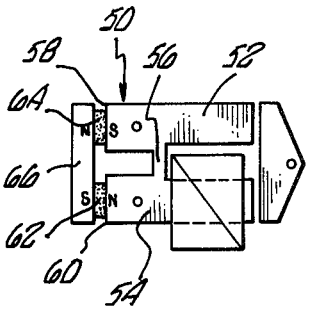
FIG. 8

FIG. 9
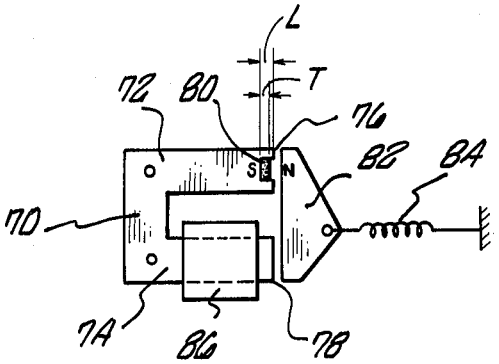
FIG. 11
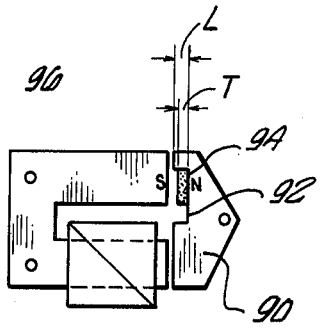
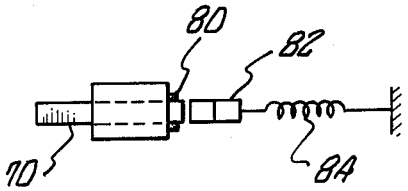
FIG. 10
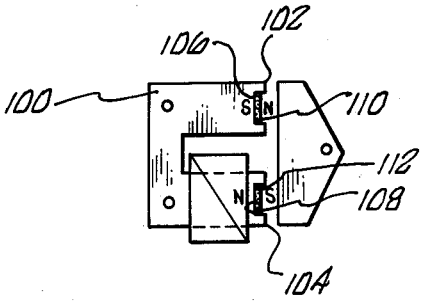
FIG. 12
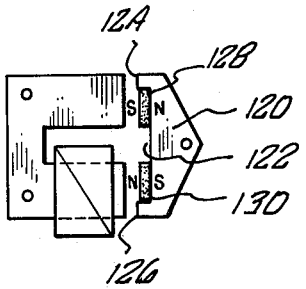
FIG. 13
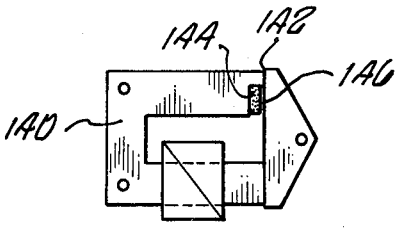
FIG. 14

MAGNETIC ACTUATOR FOR A SHUTTER MECHANISM

BACKGROUND OF THE INVENTION

The present invention is directed to a magnetic actuator device and more particularly to a magnetic actuator for a photographic shutter mechanism wherein the permanent magnet is provided as an integral portion of either the yoke or armature to form a closed passive magnetic circuit.

DESCRIPTION OF THE PRIOR ART

The use of magnets and electromagnets in the camera field has been prevalent. For example shutter mechanisms have been suggested wherein an electromagnet is energized to attract an armature to produce a desired movement for controlling a shutter. Reference is made to U.S. Pat. Nos. 3,670,636, 3,668,988 and 3,672,270 to disclose various electromagnetic and magnetic apparatus in the photographic field.

Generally an electromagnet has been used for causing a mechanical movement due to an electrical signal. To produce a desired movement, a current is introduced into a coil of the electromagnet for attracting an armature. A disadvantage is that the energy requirement for the coil current can drain the battery camera. As can be appreciated by those skilled in the art, the dimensional size and weight design parameters of a single lens reflex camera limit the size of any batteries. In addition, batteries have not generally been designed specifically for cameras and to date, most batteries used in a camera are of the same type or configuration that were primarily designed for portable radios and the like which do not require a mechanical movement.

In an attempt to conserve the camera power source, there has been proposed an arrangement wherein the armature is attracted to an energized electromagnet and is thereafter detached by the interruption of the flow of current to the electromagnet. This arrangement purportedly permits a quick release of the armature with a smaller source of power. As can be appreciated, however, considerable power drain is still required since the current must flow to the electromagnetic coil before the desired movement is required.

Another design suggestion is to utilize a permanent magnet attached to the magnetic substance of a magnetic circuit to thereby attract the armature and retain it as long as the electromagnetic coil is not energized. When the electromagnetic coil is energized, the current will produce a magnetic flux that offsets the attracting flux from the permanent magnet and thereby releases the armature. A permanent magnet-electromagnetic shutter assembly of this type has been found to require less operating current and thus to be highly adaptable for use in a shutter mechanism of a smaller size camera. Other applications requiring physical movement in a relatively restricted size with the minimal use of power are also possible. Problems exist, however, in that the contact faces of the pole portions of the yoke member must be precisely aligned to permit a flat positive interface with the armature and thereby maximize the use of the magnetic flux. Frequently, misalignment of the contact faces will create gaps that will reduce the flow of magnetic flux. The relatively small sizes of the yokes and armatures of the present invention should be appreciated to determine the tolerance problems involved in mass production. Separate pole portions that are connected to a magnet frequently require a costly post connection polishing of their contact faces to insure accurate alignment.

The prior art has not optimized this design nor provided a highly adaptable precision configuration that is compatible with mass production line requirements.

SUMMARY OF THE INVENTION

It is an object of the present invention to provide a magnetic actuator device wherein a strong magnetic attraction between magnetic pole faces and an armature can be achieved with little variation between the attracting forces on each of the magnetic pole faces and with a minimum of discrepancy or warp across their contacting interface.

It is another object of the present invention to provide an electromagnetic actuator wherein the contact faces of the yoke member will contact the complimentary surface of an armature in accurate alignment along a common plane.

Another object of the present invention is to provide an armature or yoke member having a cutaway portion to receive and retain a permanent magnet so that the magnetic actuator can be manufactured at a relatively low cost.

In accordance with another object of the present invention a yoke or armature can be provided with a hole positioned to receive a permanent magnet to thereby increase the mechanical strength of the magnet carrying member.

It is yet another object of the present invention to provide a magnetic actuator assembly wherein a yoke member can comprise a pair of integral magnetic pole members that are interconnected by a bridge portion of relatively small cross-sectional shape whereby the yoke member can form either a U- or H-shape.

According to a still further aspect of the present invention, a magnetic actuator assembly is provided having recessed portions in its contact faces wherein a permanent magnet can be fitted without protruding from the contacting surface. Thus, the permanent magnet may be protected from contact and also provide a more intimate contact for increasing the generation of magnetic flux.

The present invention provides a small magnetic actuator assembly that is particularly adapted for use in cameras and the like requiring controlled movement. The magnetically conductive yoke member has integral magnetic pole portions forming a first and second contact face. The contact faces can be polished in one production operation to form a common plane for interfacing with an armature. A relatively movable armature member has complimentary abutting surfaces capable of operatively contacting the first and second contact faces of the yoke member. The armature when contacting the yoke forms a magnetic circuit path for magnetic flux. A permanent magnet is connected to one of the yoke and armature members on at least two of its surfaces and is of such a magnetic strength that it can generate sufficient magnetic flux to attract and hold the yoke and armature members together. Resilient means such as a spring is mounted to bias the armature member away from the yoke member. The force of the spring, however, is designed to be less than the magnetic force field generated between the yoke and the armature member. Finally, an electromagnetic coil is wound to provide a magnetic force polarity opposite to that of the permanent magnet when current is introduced into the coil. The electromagnetic field generated effectively neutralizes the permanent magnetic field and permits the release of the armature member from the yoke member.

The yoke member can be casted or sintered and machined to provide contact faces that are aligned in a common plane. The magnet can be inserted into or attached onto either the yoke or armature member to provide the desired magnetic flux.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 1 discloses a plan view of a conventional small prior art electromagnetic assembly;

FIG. 2 discloses a side view of the electromagnetic assembly of FIG. 1;

FIG. 3 discloses a plan view of one embodiment of the present invention;

FIG. 4 discloses a side view of the embodiment of FIG. 3;

FIG. 5 discloses a perspective view of the yoke member of FIG. 3;

FIG. 6 discloses a plan view of another embodiment of the present invention;

FIG. 7 discloses a plan view of a further embodiment of the present invention;

FIG. 8 discloses a plan view of still another embodiment of the present invention.

FIG. 9 discloses a plan view of another embodiment of the present invention;

FIG. 10 discloses a side view of FIG. 9;

FIG. 11 discloses a plan view of another embodiment of the present invention;

FIG. 12 discloses a further plan view of another embodiment of the present invention;

FIG. 13 discloses still another plan view of another embodiment of the present invention; and FIG. 14 discloses another embodiment of the present invention.

DESCRIPTION OF THE PREFERRED EMBODIMENT

The following description is provided to enable any person skilled in the appropriate art of magnetic actuator devices, and more particularly, a magnetic assembly for a shutter in the photographic field, to make and use the invention and sets forth the best mode contemplated by the inventors of carrying out their invention. Various modifications, however, will remain readily apparent to those skilled in the art, since the generic principles of the present invention have been defined herein specifically to provide a relatively economical and easily mass-manufactured magnetic actuator for use in cameras.

Referring to FIGS. 1 and 2, a conventional prior art electromagnetic device is disclosed. The yoke member 1, is formed from a pair of magnetic pole portions 3 and 5. A permanent magnet 7, is mounted between the magnetic poles 3 and 5 and fastens them together. An electromagnetic coil 9 is mounted on the magnetic pole 5. An armature 11 is biased by a spring 13 away from the yoke 1. The end contact faces 15 and 17 of the respective pole pieces 3 and 5, are designed to contact the armature 11. When a current flows through the electromagnetic winding 9, an electromagnetic flux of opposite polarity to that of the permanent magnetic 7 is created of sufficient strength to permit the spring force of spring 13 to overcome the attracting force of the permanent magnet 7 so that the armature 11 is detached from the magnetic poles 3 and 5.

As is appreciated by those skilled in the art the armature 11 can operate some mechanism such as a shutter opening mechanism in a camera.

A disadvantage in this prior art magnetic assembly is the splitting of the yoke 1 into two small separate parts with the permanent magnet 7 interposed there between. It is difficult to align the end contact faces of the respective magnetic pole pieces 15 and 17 in a single common plane. Any discrepancy in alignment will create a clearance between armature 11 and the magnetic pole faces 15 and 17. This misalignment will reduce the armature attracting and retaining force of the magnetic poles and create a wide variance in individual mass-produced actuators. The variation in the attractive force can create problems in the timing of the shutter mechanism in a camera. It has also been found that it is difficult during the polishing process of the contact faces on the yoke, to hold the yoke and the permanent magnet without causing an alignment discrepancy in the contact faces.

Referring to FIGS. 3 and 4, a yoke and armature assembly of the present invention is disclosed wherein the yoke 2 has a U-shape with a slot 4 formed in its base portion. A pair of magnetic pole arms 6 and 8 terminate respectively in contact faces 10 and 12 lying in a common plane. A permanent magnet 14 formed, for example, from a rare earth metal capable of providing both a strong magnetic force and being compact in size can be inserted within the slot or cutaway portion 4. The permanent magnet 14 can be secured in position by an appropriate resin. An electromagnetic coil 16 can be wound about one of the pole portions with appropriate leads for electrical connection (not shown). Preferably the coil is wound about a pole portion separate from the permanent magnet. An armature 18 can be mounted on appropriate alignment guides (not shown) to permit a traverse movement to the plane of the contact faces 10 and 12. A spring 20 is mounted to bias the armature 18 away from the contact faces. The introduction of appropriate current into the electromagnetic coil will counter the magnetic flux generated by the permanent magnet 14 and thereby permit the spring force to release the armature 18 from the contact faces. The spring force is designed to be less than the attractive magnet force of the permanent magnet. A feature of this embodiment of the present invention resides in the interconnecting portion 22 on the base of the yoke 2 with a small width, $\omega$. The yoke 2 of this invention is a continuous integral body member that may be machined or cast sintered as one piece. Accordingly, the magnetic pole contact faces 10 and 12 can be polished with one operation and thus accurately aligned by mass-production techniques. The majority of the magnetic flux created by the permanent magnet 14, will pass through a magnetic circuit path consisting of the yoke 2 and the armature 18. A minor part of the magnetic flux will pass through the relatively small interconnecting portion 22 on the base of the yoke 2. The thickness of the interconnection portion 22 is designed so that it can be magnetically saturated since it has a much smaller cross-sectional area than the other portions of the yoke 2 thereby minimizing any loss in retaining force between the armature 18 and the yoke 2. This minor loss is negligible when balanced against the advantages of providing accurately aligned pole contact faces which insure a strong application of magnetic flux to the armature 18. Mounting holes can also be provided in the base of the yoke member 2.

The further embodiment of the present invention can be seen in FIG. 6 wherein a rectangular hole has been provided in the base of the U-shaped yoke 30. Again, both magnetic pole portions 32 and 34 are integrally connected to permit a mass-production line polishing of the contact faces in a highly accurate configuration. The peripheral portion of the base of the yoke 30 surrounding the hole is again of a much smaller cross-sectional area than the other portions of the yoke and can be magnetically saturated to insure that the major portion of the magnetic flux can be usefully utilized in maintaining the armature 36 in contact with the yoke 30. As can be appreciated, means can be provided for appropriately biasing the armature as disclosed in the embodiments of FIGS. 3 through 5.

Referring to FIG. 7, which shows another embodiment of the present invention, a cutaway portion 44 is provided in the armature 42, instead of the yoke 40, with the permanent magnet 46 being inserted in that portion. The portion 48 is made of a limited thickness so that it can be magnetically saturated due to its smaller cross-sectional area than the other portions of the armature 48 thereby minimizing any loss in retaining force between the armature 42 and the yoke 40. The permanent magnet may be provided in the armature, as is apparent from this embodiment.

Another embodiment of the present invention is disclosed in FIG. 8, wherein an H-shaped yoke 50 has a pair of pole portions legs 52 and 54 that are integrally connected by an interconnecting portion 56. Secured to the rear faces 58 and 60 of the magnetic pole portions are a pair of permanent magnets 64 and 62. The magnets 62 and 64 are further in contact with a supplemental yoke member 66. The magnetic flux loop contains both the pole pieces 52 and 54 and the supplemental yoke 66. A minor portion of the flux will pass through the reduced cross-sectional area interconnecting portion 56. It is possible to cast or cut the yoke 50 to include an integral supplemental yoke 66 so that the entire yoke 50 is actually one piece.

Referring to FIG. 9 another embodiment of the present invention is disclosed wherein a permanent magnet 80 is secured on or adjacent a contact face of either the yoke or armature. In FIG. 9, a U-shaped yoke 70 has a pair of magnetic pole portion legs 72 and 74. A contact face 76, on pole portion 72 has a recessed portion of a depth L, centrally located on the magnetic contact face. A magnet of a thickness T, less than the depth L, is mounted in the recessed portion. Both the split magnetic contact face 76 and the contact face 78 on the pole portion 74 can be machine finished so that they will align in a precise common plane before the installation of the permanent magnet 80. An armature 82 can be biased by a spring 84 in a predetermined direction away from the yoke 70. An electromagnetic winding 86 has appropriate electrical contacts (not shown) for receiving the desired current. Preferably the winding 86 is mounted on the magnetic pole portion 74 with the flat contact face 78. The magnetic flux generated by the permanent magnet 80 passes through the pole faces 76 and 78 and forms with the armature 82 and the yoke 70 a closed magnetic circuit. There is relatively little magnetic flux loss with this arrangement since the magnet is of sufficient strength to insure an intimate contact between both contact faces of the yoke 70 and the armature 82.

FIG. 10 shows a side view of the embodiment of FIG. 9 and as can be seen, the magnet 80 extends above and beyond the thickness of the pole portions 72 and 74. If desired the recessed portion of the contact face 76 can be reinforced with an annular wall (not shown).

In the embodiment shown in FIG. 11 a recessed portion 92 is provided on the contact face surface of the armature 90. The recessed portion 92 receives a permanent magnet 94 having a thickness T. The depth of the recessed portion 92 has a dimension L which is greater than the thickness T. The yoke 96 has an integral U-shaped configuration.

The embodiment of FIG. 12 discloses an integral U-shaped yoke 100 having a pair of contact faces 102 and 104. Each contact face has a cutaway portion or recession 106 and 108 respectively. Mounted within the cutaway portions are magnets 110 and 112 respectively. As with the previous embodiments shown in FIGS. 9 through 11, the contact surfaces provided a minor clearance between the permanent magnets and the respective interfacing magnet pole faces.

While this clearance need not be provided in order to adhere the armature to the yoke, it is frequently found that the permanent magnet is made of a brittle material and that it is preferable that direct contact between either the armature or the yoke with the magnet be avoided. In addition, the actual thickness of the permanent magnets have a minor tolerance variation and accordingly the provision of a clearance compensates for this variation. A design clearance or gap increases the resistance of the magnetic circuit slightly, however, the relative resistance increase is minor compared to the tolerance advantages of a mass-manufacturing of the actuator assembly. Finally this increase in magnetic resistance is relatively minor compared to the problems of the prior art of an actual misalignment between the armature and the yoke contact faces wherein a gap can exist across most of the face of the contacts.

Referring to the embodiment of FIG. 13, the armature 120 has been modified to include a recess 122 extending from one contact face 124 across the width of the armature 120 to the other contact face 126. A pair of permanent magnets 128 and 130 are appropriately mounted adjacent each respective contact face.

Finally, the embodiment of FIG. 14 discloses a modified yoke 140 having on one contact face 142 a shoulder portion 144 mounting a permanent magnet 146. Again the yoke 140 is an integral one piece construction that can be easily machined or polished to provide precise aligned contact faces. In the embodiment shown in FIGS. 9 and 11, a single permanent magnet is provided on only one of the magnetic pole faces either on the side of the yoke or on the side of the armature. When current flows through the electromagnetic winding to provide a counter magnetic flux to that of the permanent magnet, then the magnetic flux created by the winding will leak from the contacting area between the magnetic pole face and that movable piece on the permanent magnet. As a result, the electromagnetic attracting force will be reduced also on the magnetic pole face which does not include the permanent magnet. Accordingly, less force will be required for detaching the armature from the magnetic pole face of the pole piece not containing the permanent magnet. Thus, a less coil current will be required for detaching the movable piece from the yoke.

While the preferred embodiments have been disclosed in an enabling manner to facilitate the reproduction of the present invention, it should be realized that various modifications can be easily accomplished by a person skilled in this field, and accordingly, the present invention should be measured solely from the following claims:

What is claimed:

1. A magnetic actuator device for providing a controlled movement for use in cameras and the like comprising;

a flat platelike magnetically conductive yoke member having an integral first magnetic pole portion terminating in a first contact face and an integral second magnetic pole portion terminating in a second contact face, said first and second magnetic pole portions being formed in one body;

a relatively movable armature member having abutting surfaces capable of operatively contacting the first and second contact faces of the yoke, the armature member when contacting the yoke member forming a magnetic circuit path for magnetic flux;

a permanent magnet connected to one of the yoke and armature members and of such strength to generate sufficient magnetic flux to attract the yoke and armature members together;

a permanent magnet housing portion for retaining the permanent magnet in the magnetic circuit, the permanent magnet housing portion consisting of a retaining portion for retaining said permanent magnet in such a manner as not to protrude beyond the contacting surfaces of either one of armature member and the yoke member, when the armature member and yoke member abut each other and a member portion having a high magnetic resistance and positioned adjacent the retaining portion, the member portion having a relatively small cross sectional area to suppress the amount of a magnetic flux running there through whereby a majority of the magnetic flux created by the permanent magnet will run through the magnetic circuit path; and an electrically conductive coil for generating in the yoke member a magnetic flux of a polarity opposite that of the permanent magnet to thereby release the armature from the attracting force of the permanent magnet.

2. The invention of claim 1, wherein the permanent magnet housing portion is provided in the yoke member.

3. The invention of claim 2, wherein the retaining portion of the permanent magnet housing portion is provided in the yoke member, the retaining portion being defined by three surfaces, thereby providing a cut-away portion in the yoke member, the permanent magnet being rigidly fitted in the cut-away portion.

4. The invention of claim 3, wherein the retaining portion defined by the three surfaces is positioned midway between first magnetic pole portion and the second magnetic pole portion.

5. The invention of claim 3, wherein the retaining portion defined by the three surfaces is provided in the contact faces of the yoke which contacts the armature.

6. The invention of claim 2, wherein the retaining portion of the permanent magnet housing portion is provided in the yoke member, the retaining portion being defined by four surfaces which provide a through-hole in the yoke member, the permanent magnet being rigidly fitted in the through-hole.

7. The invention of claim 6, wherein the retaining portion defined by the four surfaces is positioned midway between the first magnetic pole portion and the second magnetic portion of the yoke member.

8. The invention of claim 6, wherein the retaining portion defined by the four surfaces is provided in either one of the first and second magnetic pole portions.

9. The invention of claim 2, wherein the permanent magnet housing portion is provided in an end face of the magnetic pole portion of the yoke member, and is defined by two surfaces providing a cut-away portion in the yoke member.

10. The invention of claim 1, wherein the permanent magnet housing portion is provided in the armature member.

11. The invention of claim 10, wherein the retaining portion of the permanent magnet housing portion is provided in the armature member and defined at least by three surfaces providing a recessed portion having a rectangular cross section in said armature, the permanent magnet being rigidly secured in the recessed portion.

12. The invention of claim 11, wherein the recessed portion is defined at least by three surfaces provided in one portion of the surface which contacts the first magnetic pole portion and another portion of the surface which contacts the second magnetic pole portion.

13. The invention of claim 11, wherein the recessed portion is provided in a surface of the armature member which contacts the yoke member and covers a portion of the surface of the armature member which contacts the first magnetic pole portion, and a portion of the surface of the armature member which contacts the second magnetic pole portion of the yoke member, the permanent magnet consisting of a pair of permanent magnets which are provided respectively on the bottom surface of the recessed portion which faces the first and second magnetic pole portions, the pair of magnets being aligned to provide the same polarity in the magnetic circuit.

14. The invention of claim 1 wherein the yoke member has a H-shaped configuration.

15. The invention of claim 1 further including means for biasing the armature away from the yoke member.

16. In a camera having a magnetic actuator device for controlling the movement of a shutter, the improvement comprising;

a one piece U-shaped magnetically conductive yoke member having an integral first magnetic pole portion terminating in a first contact face and an integral second magnetic pole portion terminating in a second contact face, said pole portions interconnected by a base portion and said contact faces lying in the same plane;

a relatively movable armature member having a continuous flat surface of complimentary configuration to each of said contact faces and capable of operatively contacting said first and second contact faces of said yoke member, said armature member when contacting said yoke member forming a magnetic circuit path for magnetic flux, and a permanent magnet connected to said yoke member, said base portion having a slot for receiving said magnet extending across a major portion of said base portion, the adjacent minor portion of said base portion has a relatively small cross-sectional area to suppress the amount of magnetic flux as a result of saturation so that a majority of the magnetic flux created by the permanent magnet will run through the magnetic circuit path.

17. The invention of claim 16 wherein the thickness of said yoke member is approximately the same as said movable armature member.

18. The invention of claim 16 further including spring means to bias said armature member away from said yoke member contact faces.

19. A magnetic actuator device for providing a controlled movement for use in cameras and the like comprising;

a magnetically conductive yoke member having an integral first magnetic pole portion terminating in a first contact face and an integral second magnetic pole portion terminating in a second contact face, said first and second magnetic pole portions being formed in one body;

a relatively movable armature member having abutting surfaces capable of operatively contacting the first and second contact faces of the yoke, the armature member when contacting the yoke member forming a magnetic circuit path for magnetic flux; and a permanent magnet connected to one of the yoke and armature members and of such strength to generate sufficient magnetic flux to attract the yoke and armature members together wherein the yoke member has a U-shaped configuration, one of said yoke and armature members having a permanent magnet housing portion at a position to allow the armature member to contact the whole surface of at least said first contact face the permanent magnet portion including a relatively small cross-sectional area to supress the amount of magnetic flux running therethrough whereby a majority of the magnetic flux created by the permanent magnet will run through the magnetic circuit path.

20. The invention of claim 19 further including means for biasing the armature away from the yoke member and an electrically conductive coil wound on to said first magnetic pole portion for generating in the yoke member a magnetic flux of a polarity opposite that of the permanent magnet to thereby release the armature from the attracting force of the permanent magnet.

21. The invention of claim 20, wherein said contact faces are in the same plane and the permanent magnet housing portion is defined by recessed portion provided midway between the two portions of the contact surface of the armature which are capable of contacting the first and second contact faces of the yoke member.

* * * * *